United States Patent [19]

Hintermann et al.

[11] 4,289,357

[45] Sep. 15, 1981

[54] HOLLOW CUTTING HEAD

[75] Inventors: Rudolf Hintermann; Alfred Zitz; Otto Schetina; Herwig Wrulich, all of Zeltweg, Austria

[73] Assignee: Voest-Alpine Aktiengesellschaft, Vienna, Austria

[21] Appl. No.: 112,614

[22] Filed: Jan. 16, 1980

[30] Foreign Application Priority Data

Feb. 9, 1979 [AT] Austria ..... 998/79

[51] Int. Cl.[3] ..... E21C 35/22

[52] U.S. Cl. ..... 299/81; 299/76

[58] Field of Search ..... 299/81

[56] References Cited

U.S. PATENT DOCUMENTS 3,954,302 5/1976 Browning ..... 299/81

FOREIGN PATENT DOCUMENTS 123619 1/1967 Czechoslovakia ..... 299/81

934289 8/1963 United Kingdom ..... 299/81

996962 6/1965 United Kingdom ..... 299/81

*Primary Examiner*—Ernest R. Purser

*Attorney, Agent, or Firm*—Cushman, Darby & Cushman

[57] ABSTRACT

The cutting head (6) is a hollow cutting head and rotatably supported on a carrier (11). Water is supplied to the nozzles of the cutting head (6) via a supply tube (29) rigidly connected to the carrier (11) in the axis of rotation and opening into a distribution chamber (30) within the cutting head (6). From this distribution chamber (30) the water is fed via passages into annular gaps (43, 46) extending in axial direction. Passages (47, 48) are opening into these annular gaps (43, 46) for supplying the water to the nozzles. A sealing (31) is only required where the water supply tube (29) is opening into the distributing chamber (30).

9 Claims, 4 Drawing Figures

HOLLOW CUTTING HEAD

When cutting coal seams, high temperatures are generated at the bits so that cooling of the bits is of advantage. If the seam, for example coal seam, includes hard lumps of rock or if unproductive rock must be cut, sparks can be produced which give rise to the danger of an explosion of the marsh gas coming out of the seam. For this reason it has already been proposed to cool the bits with water. In this connection it is also known to arrange the water nozzles on the cutting head itself such that the water jet is immediately directed against the bits. Such nozzles are, however, subjected to the dust produced during cutting operation and for preventing clogging of these nozzles it becomes necessary to supply water to the nozzles under as high a pressure as possible. The cutting head is rotating and the water must be supplied to the cutting head via the carrier for the cutting head, i.e. generally via the cutting arm. The higher the water pressure the more difficult is to achieve a tight seal of the water path between the stationary carrier and the rotating cutting head and thus there exists an upper limit for the water pressure in the known devices. The cutting head is provided with a big number of bits what requires a big number of nozzles on the cutting head which nozzles must be connected with a chamber from which the water is supplied to the nozzles. Also such an arrangement involves difficulties.

There are known constructions in which the cutting head has a cavity and a carrier rigidly connected with a cutting arm is extending into this cavity. In such constructions there is, for example, arranged within the hollow cutting head the last gearing step of the drive means for the cutting head and this last gearing step must be included in the lubricating oil circuit. In this case the danger is existing that in case of a failure of the sealing between stationary portion and rotating cutting head water can enter the lubricating oil circuit. This results in a reduced lubricating capacity of the lubricating oil and in the danger of impairing the gearing of the drive means of the cutting head.

The invention now refers to a hollow cutting head provided with bits and adapted to be rotatably supported on a carrier protruding into the hollow cutting head and being provided with cooling water nozzles which are directed against the bits, noting that the cooling water can be supplied to the cooling water nozzles via the cutting head body and passages provided therein, and the invention aims at providing an effective seal of the water supply system even with high water supply pressures as for instance pressures exceeding 300 bar and particularly exceeding 400 bar and further aims at establishing a simple water path for feeding the nozzles with water. The invention essentially consists in that a distributing chamber is provided within the cutting head and arranged in alignment with a water supply tube rigidly arranged in the axis of the carrier, noting that the water supply tube is opening into the distributing chamber and is adapted to be sealingly connected to the distributing chamber of the rotatably supported cutting head body, in that at least one annular gap extending in axial direction of the cutting head is provided within the cutting head body, in that said annular gap is connected to the distributing chamber over at least one passage and in that passages are opening into the annular gap which lead to the cooling water nozzles. In view of the seal between the stationary portion or constructional part and the rotating cutting head being now placed into the axis of rotation, the problem of providing a tight seal becomes substantially facilitated. In view of the annular gap or the annular gaps, which are supplied with water from the distributing chamber located in the area of the axis of the cutting head via passages, extending in axial direction of the cutting head, the nozzles can be connected with the water supply chamber via approximately radially extending bores all of which are opening into the annular gap or into the annular gaps. This results in a simple construction. One can do with only short passages or bores and mutually intersecting bores are avoided which become necessary when there exists the necessity to provide sharply bent passages. Thus the pressure drop within the passages is reduced to a minimum while the pressure drop within the annular gap or annular gaps can be neglected in view of the relatively low flow velocities existing therein. The supply pressure of the water can thus be made substantially fully effective at the nozzles and any clogging of the nozzles is counteracted. The walls of the annular gap or of the annular gaps have approximately cylindrical shape in a cutting head. Such a cylindrical wall can without difficulties resist even high pressures. The stress on the end walls delimiting the ring gap is however unfavourable. This applies particularly in a known embodiment in which the cutting head body is composed of axially superimposed discs which are mutually welded. In this case the weld seams are stressed by the load acting on the end walls of the annular gap. The areas of the end walls of an annular gap are, however, substantially smaller than the cylindrical walls delimiting the annular gap so that the total pressure acting on these end walls can without further be resisted even with high supply pressure of the water. In a known embodiment in which the cutting head is composed of axially superimposed and mutually welded discs, the surface area of one end wall delimiting the annular gap is only a fraction, preferably 1/10 to 1/20 of the surface area of the circumferential surface of the annular gap, noting that the annular gap extends over at least $\frac{1}{3}$ of the axial length of the cutting head. This results in a simple construction of high pressure resistance.

The inventive construction of the cutting head provides for the possibility to supply to the cutting head cooling water under a considerably high pressure and to make this pressure effective at the nozzles without substantial losses, so that the nozzles are reliably prevented from becoming clogged. According to the invention, the cooling water is supplied to the cutting head under a pressure of more than 300 bar, preferably under a pressure of approximately 400 bar. In cutting heads of known constructions it was not possible to increase the supply pressure of the cooling water for the cutting head over 20 to 30 bar.

According to a preferred embodiment of the invention, the water supply tube can sealingly be passed through a wall rotating with the cutting head and delimiting a chamber separated from the oil chamber of the cutting head drive means and from the anti-friction bearings carrying the cutting head. This has as an effect that with only a minor untightness of the seal between the stationary constructional part and the rotating cutting head, the water passing through the untight seal does not immediately enter the lubricating oil circuit. According to the invention, this chamber separated from the oil chamber is preferably in connection with the atmosphere so that even with a more considerable untightness no pressure can be built up in this chamber separated from the oil chamber. The sealing arranged in the wall rotating with the cutting head is now not subjected to the supply pressure and warrants a complete seal. According to the invention, the chamber separated from the oil chamber can be connected to the atmosphere via a check valve opening in direction to the atmosphere and/or a labyrinth seal or the like so that dust and foreign matter are prevented from entering the chamber separated from the oil chamber.

The invention is further illustrated with reference to the drawing schematically showing an embodiment.

Figure 1:
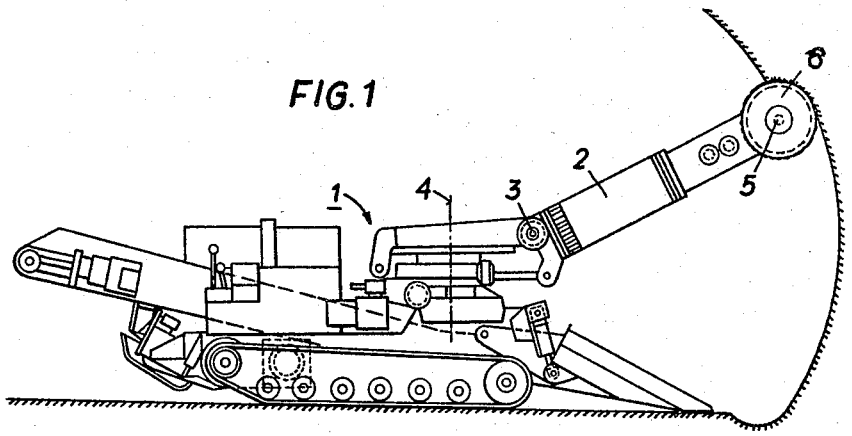
FIG. 1 shows a cutting machine.

As is shown in FIG. 1, the cutting machine 1 has a cutting arm 2 which can be swivelled in upward and downward direction around the horizontal axis 3 and can be laterally swivelled around a vertical axis 4. On both sides of the cutting arm 2 one cutting head 6 each is rotatably supported around an axis 5.

Figure 2:
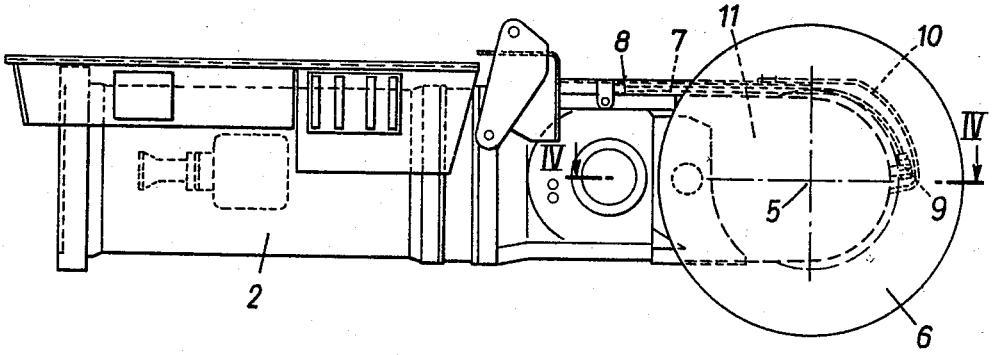
FIGS. 2 and 3 show in a lateral view and a top plan view, respectively, a cutting arm together with the cutting heads
Figure 3:
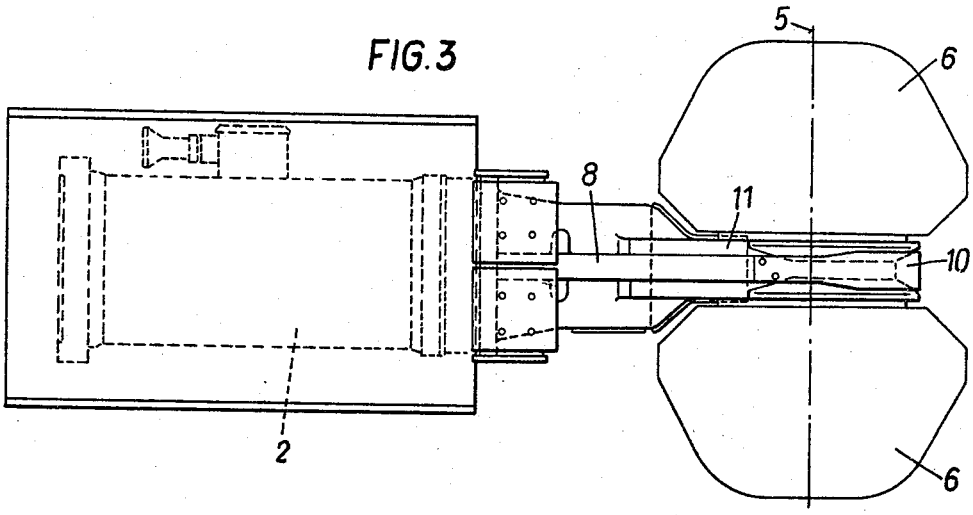

As is shown in FIGS. 2 and 3, a cooling water conduit 7 is provided along the top surface of the cutting arm 2 and protected against downwardly falling rock by a U-profile 8. This cooling water conduit is passed over the end of the cutting arm 2 and is connected to the cutting arm by a screw connection 9. 10 is a cover plate protecting the foremost portion of the cooling water conduit 7. Cooling water is supplied under high pressure by means of a pump not shown into the cooling water conduit 7.

A carrier 11 is rigidly connected to the cutting arm and extending into the hollow cutting head body 12 provided with bits. The cutting head body 12 is composed of axially superimposed discs 13, 14, 15, 16, 17 which are mutually welded. These discs 13 to 17 surround a cylindrical central portion 18 of the cutting head body and this central portion 18 is welded to the mutually welded discs 13 to 17. This welded unit 13 to 17 and 18 is covered by an end portion 19 which is by means of screws 20 screwedly connected to the welded unit 13 to 17 and 18. A ring 21 and a plate member 22 are in their turn welded to this end portion 19. A central annular part 23 is welded into the plate member 22 and a central insert 24 is screwedly connected with this annular part 23.

The cooling water is fed to a central cavity 28 within the carrier 11 from the screw connection 9 via a passage 25 on the cutting arm 2 and passages 26 and 27 within the carrier 11 rigidly connected to the cutting arm. A tube 29 rigidly connected to the carrier 11 is connected to the central cavity 28 and is in alignment with the axis of the cutting head 6. This tube 29 opens into a distributing chamber 30 which is located within the insert 24. By means of a sealing 31 the end of this tube 29 is sealingly guided within the insert 24. This insert 24 is together with the cutting head rotating around this stationary tube 29. In view of this tube being in alignment with the axis of the cutting head 6, this tube can reliably be sealed by means of the sealing 31.

The cutting head body is rotatably supported by means of anti-friction bearings 32, 33 and 34 on the carrier 11 rigidly connected to the cutting arm 2. The outer bearing ring 35 of the anti-friction bearing 34 is rigidly connected with, for example screwed into the cutting head body and closed by a lid 36. A cavity 37 is formed between the lid 36 and the plate member 22. Within the interior of the carrier 11 a planet gear not shown is arranged which represents the last gearing step. This planet gear and also the anti-friction bearings 32, 33 and 34 are operating within an oil bath which is in connection with the lubricating oil circuit of the gearing. The cavity 37 is tightly closed against this oil chamber by means of the lid 36. 38 is an overload friction clutch via which the cutting head body composed of the parts 13 to 22 is connected with a hub 39 which is rotatably supported on the carrier 11 by means of the anti-friction bearings 32, 33 and 34.

The central tube 29 rigidly connected to the carrier is also sealingly guided within the lid 36 by means of a seal 40. This has as an effect that any water passing through the sealing 31 can not enter the lubricating oil circuit but only enter into the cavity 37. This cavity 37 is in connection with the atmosphere via a passage 41 so that no pressure can be built up within the cavity 37. A check valve not shown and opening in outward direction and/or a labyrinth seal can be mounted within this passage 41 so that foreign matter is prevented from entering the cavity 37.

Via a passage 42 the cooling water enters an annular gap 43 and then flows through further passages 44 and 45 to an annular gap 46. Said both annular gaps 43 and 46 substantially extend over the whole axial length of a cutting head body. The cooling water nozzles not shown are located on the circumference of the cutting head body and each radial passage extending from the circumferential surface in inward direction must open into one of the annular gaps 43 or 46. In the drawing the radial passages 47 and 48 of a plurality of such passages are shown. The passages leading to the further nozzle are not located in the section plane of FIG. 4. All nozzles can thus be supplied with water from these annular gaps 43 and 46. The annular gap 46 is located between the central portion 18 and the group of mutually welded discs 13 to 17. The annular gap 43 is located between the end portion 19 and the ring 21. These annular gaps can thus easily be kept free prior to welding together the individual parts. In view of the supply pressure being selected high and being for example 400 bar, the pressure load acting on the cylindrical walls of the annular gap 43 and 46 is considerable. The cylindrical walls of the annular gap 43 and 46 have a great surface area. These pressure stresses can, however be resisted by the disc 13 to 17 delimiting the annular gap 46 and by the central portion 18. The pressure load acting on the front ends 49 and 50 of the annular gap 46 subjects, however, the welding seams between the individual discs 13 to 17. In view of the width of the annular gap being kept very small such pressure load is only small and thus not dangerous even with very high supply pressure of the cooling water.

Figure 4:
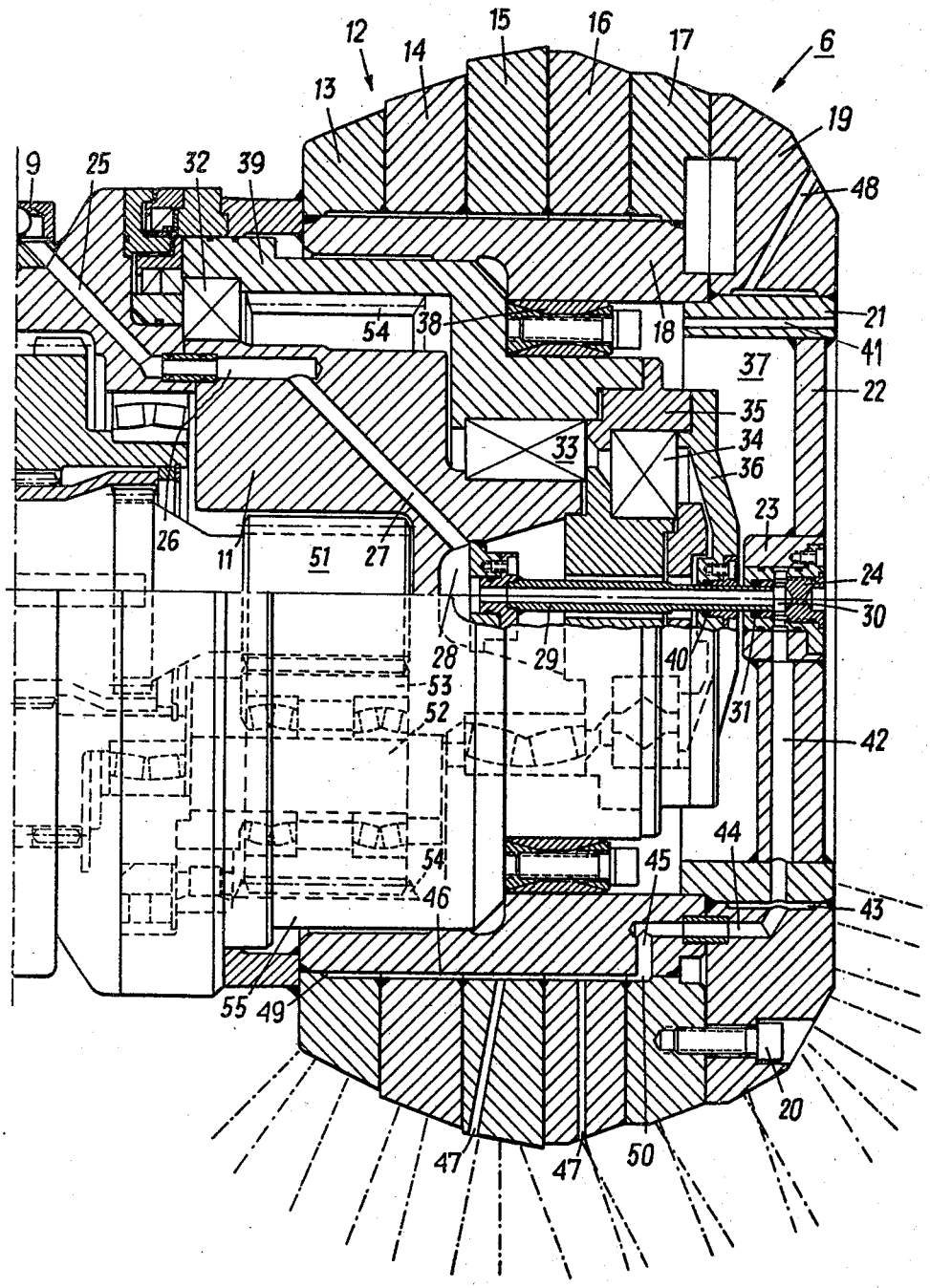
FIG. 4 shows a section through one of the cutting heads and of the cutting arm in an enlarged scale and in a section along line IV—IV of FIG. 2.

In FIG. 4 also the drive means for the cutting head is schematically shown. The toothed end of the drive shaft is designated 51, the teeth of which are cooperating with intermediate tooth gears 53 supported on axes 52 in the carrier 11. These intermediate tooth gears are in engagement with an internal toothing 54 of a hollow wheel forming part of the rotatably supported cutting head 6.

What is claimed is:

1. A cutting assembly for a cutting machine comprising: a hollow rotatable cutting head having a forward end and a open rear end, said cutting head having nozzles on its periphery for discharging cooling water and having internal cooling water passages connecting with the nozzles; a carrier protruding into the open end of said cutting head and forming therewith an oil chamber which is closed at its forward end by a generally transverse wall forming part of said rotatable cutting head, said wall also closing a cavity which is provided in said cutting head, and which is in communication with the atmosphere via a passage; bearings in said oil chamber for rotably supporting said cutting head on the carrier; drive means supported by the carrier and gear connected to said cutting head at a location in said oil chamber; and a cooling water distribution system including a water supply tube carried by the carrier and arranged coaxially therein, said water supply tube passing through said generally transverse wall and through said cavity and opening into a water distributing chamber provided within said cutting head in alignment with said water supply tube, sealing means between said water supply tube and said generally transverse wall and between said water supply tube and said water distributing chamber, and at least one longitudinally extending annual gap provided within said cutting head, said gap being connected to said water distributing chamber by at least one passage and said gap communicating with said internal cooling water passages.

2. A cutting assembly as in claim 1 wherein at least one annular gap extends at least one third of the axial length of the said cutting head.

3. A cutting assembly as in claim 2 wherein said gap extends about one half the axial length of said cutting head.

4. A cutting assembly as in claim 1, 2 or 3 wherein said cutting head includes an assembly of axially superimposed annular discs welded together, the inner surface of the assembly of discs forming the outer surface of said annular gap, said gap having end surfaces the area of which is only a fraction of the circumferential surface area of said gap.

5. A cutting assembly as in claim 4 wherein the area of said end surfaces is 1/10 to 1/20 of the circumferential surface area of said gap.

6. A cutting assembly as in claim 1, 2 or 3 including means in said passage associated with said cavity for preventing entry of foreign matter into said cavity.

7. A cutting assembly as in claim 6 wherein said means includes a check valve opening in an outward direction.

8. A cutting assembly as in claim 6 wherein said means includes a labyrinth seal.

9. A cutting assembly as in claim 1, 2 or 3 including means for supplying cooling water to said cooling water distribution system at a pressure of more than 300 bar.

* * * * *